US010490364B2

(12) United States Patent
Gutmann et al.

(10) Patent No.: US 10,490,364 B2
(45) Date of Patent: Nov. 26, 2019

(54) SPRING MEMBER FOR AN ELECTRICAL SWITCHING ELEMENT

(71) Applicant: Tyco Electronics Austria GmbH, Vienna (AT)

(72) Inventors: Markus Gutmann, Brand (AT); Rudolf Mikl, Maria Ellend (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 15/661,545

(22) Filed: Jul. 27, 2017

(65) Prior Publication Data

US 2017/0323740 A1 Nov. 9, 2017

Related U.S. Application Data

(63) Continuation of application No. PCT/EP2016/052004, filed on Jan. 29, 2016.

(30) Foreign Application Priority Data

Jan. 30, 2015 (EP) ..... 15153205

(51) Int. Cl.

| | |
|---|---|
| ***H01H 3/38*** | (2006.01) |
| ***H01R 13/24*** | (2006.01) |
| ***H01H 50/64*** | (2006.01) |
| *H01H 3/48* | (2006.01) |
| *H01H 50/56* | (2006.01) |

(52) U.S. Cl.

CPC ..... *H01H 3/38* (2013.01); *H01H 50/642* (2013.01); *H01R 13/2442* (2013.01); *H01H 3/48* (2013.01); *H01H 50/56* (2013.01); *H01H 2205/002* (2013.01)

(58) Field of Classification Search

CPC .. H01H 3/38; H01H 1/14; H01H 1/24; H01H 1/26; H01H 1/30; H01H 2001/265; H01H 50/56; H01R 13/2442; H01R 13/187; H01R 13/17

See application file for complete search history.

(56) References Cited

U.S. PATENT DOCUMENTS 5,350,322 A * 9/1994 Kondo ..... H01R 33/46 439/667
6,940,375 B2 * 9/2005 Sanada ..... H01H 50/56 335/129

(Continued)

FOREIGN PATENT DOCUMENTS

CN 1499557 A 5/2004
CN 102646521 A 8/2012

(Continued)

OTHER PUBLICATIONS

Chinese First Office Action, English translation, dated Jun. 26, 2018, 8 pages.

(Continued)

*Primary Examiner* — Felix O Figueroa
(74) *Attorney, Agent, or Firm* — Barley Snyder

(57) ABSTRACT

A spring for an electrical switch comprises a contact arm and a base from which the contact arm extends. The contact arm has a contact member. The base has a terminal and an extension. The extension extends from the contact arm to the terminal and away from a remaining base.

19 Claims, 3 Drawing Sheets

(56) References Cited

U.S. PATENT DOCUMENTS

| | | | | |
|---|---|---|---|---|
| 6,976,888 | B2 * | 12/2005 | Shirai | H01R 13/2442 439/733.1 |
| 7,297,010 | B2 * | 11/2007 | Tsai | H01R 13/2442 439/331 |
| 8,222,981 | B1 | 7/2012 | Zarbock et al. | |
| 8,816,800 | B2 | 8/2014 | Mikl | |

FOREIGN PATENT DOCUMENTS

| | | | |
|---|---|---|---|
| DE | 3147563 | A1 | 10/1982 |
| EP | 2477203 | A1 | 7/2012 |
| JP | S5245043 | A | 4/1977 |
| JP | 2012-129206 | A | 7/2012 |
| JP | 2013-218888 | A | 10/2013 |

OTHER PUBLICATIONS

Japanese Notice of Reasons for Refusal, English translation, dated Jul. 3, 2018, 4 pages.
Abstract of JPS5245043A, dated Apr. 8, 1977, 1 page.
Abstract of JP2013218888, dated Oct. 24, 2013, 1 page.
European Search Report, dated Aug. 6, 2015, 6 pages.

* cited by examiner

SPRING MEMBER FOR AN ELECTRICAL SWITCHING ELEMENT

CROSS-REFERENCE TO RELATED APPLICATIONS

This application is a continuation of PCT International Application No. PCT/EP2016/052004, filed on Jan. 29, 2016, which claims priority under 35 U.S.C. § 119 to European Patent Application No. 15153205.8, filed on Jan. 30, 2015.

FIELD OF THE INVENTION

The present invention relates to a spring and, more particularly, to a spring for an electric switch such as a relay.

BACKGROUND

Known springs used in electric switches such as relays or contactors have a contact arm with a contact member and a base from which the contact arm extends. The base has a terminal. The known springs are used within the electrical switches to open or close an electrical circuit. In miniaturized and standardized systems, the available space for springs in electrical switches is limited, making it difficult to provide a spring which fulfills elasticity and conductivity requirements of the electrical switch.

SUMMARY

A spring for an electrical switch according to the invention comprises a contact arm and a base from which the contact arm extends. The contact arm has a contact member. The base has a terminal and an extension. The extension extends from the contact arm to the terminal and away from a remaining base.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
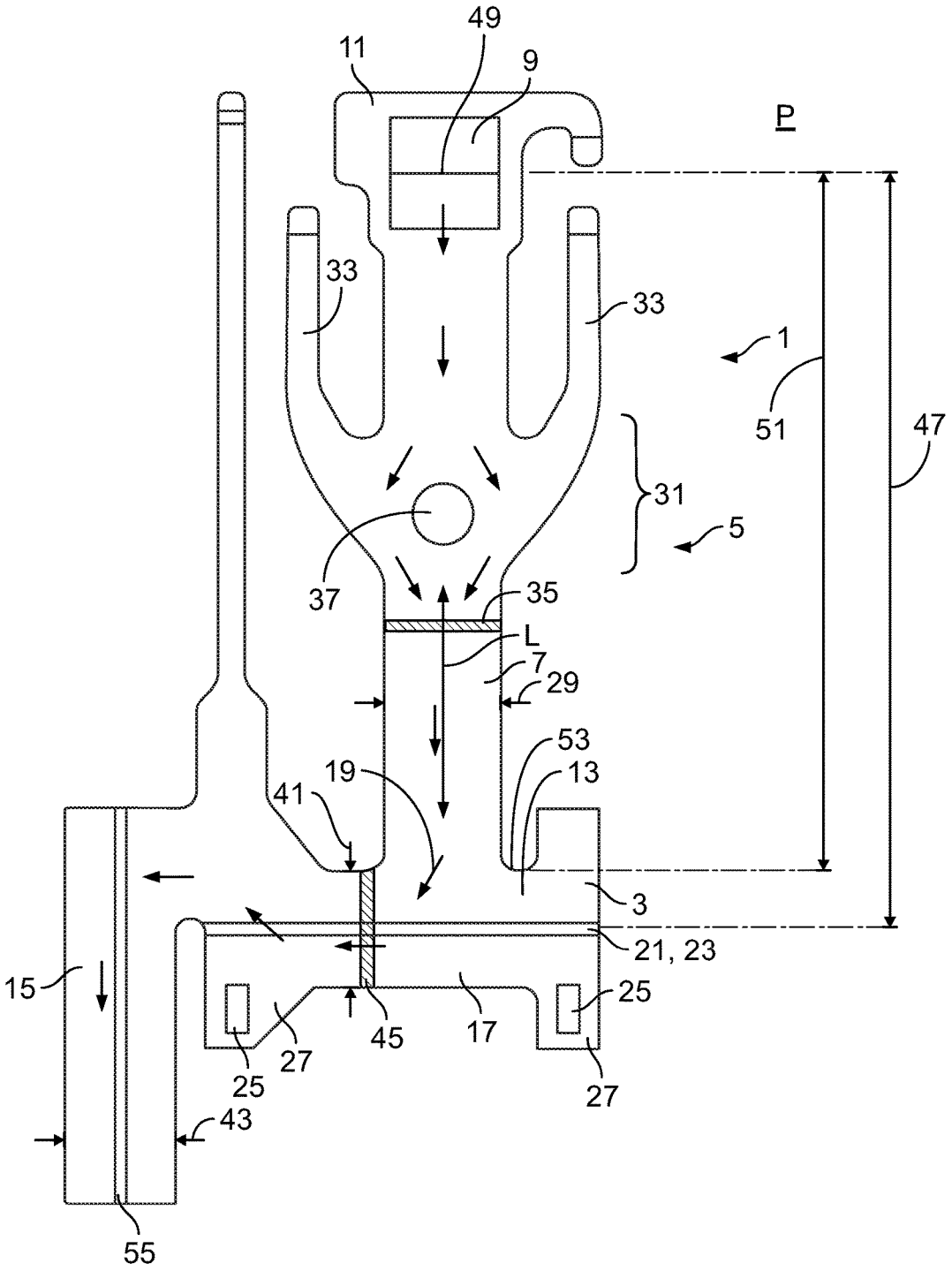
FIG. 1 is a top view of a spring according to the invention in a pre-bent state.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 2:
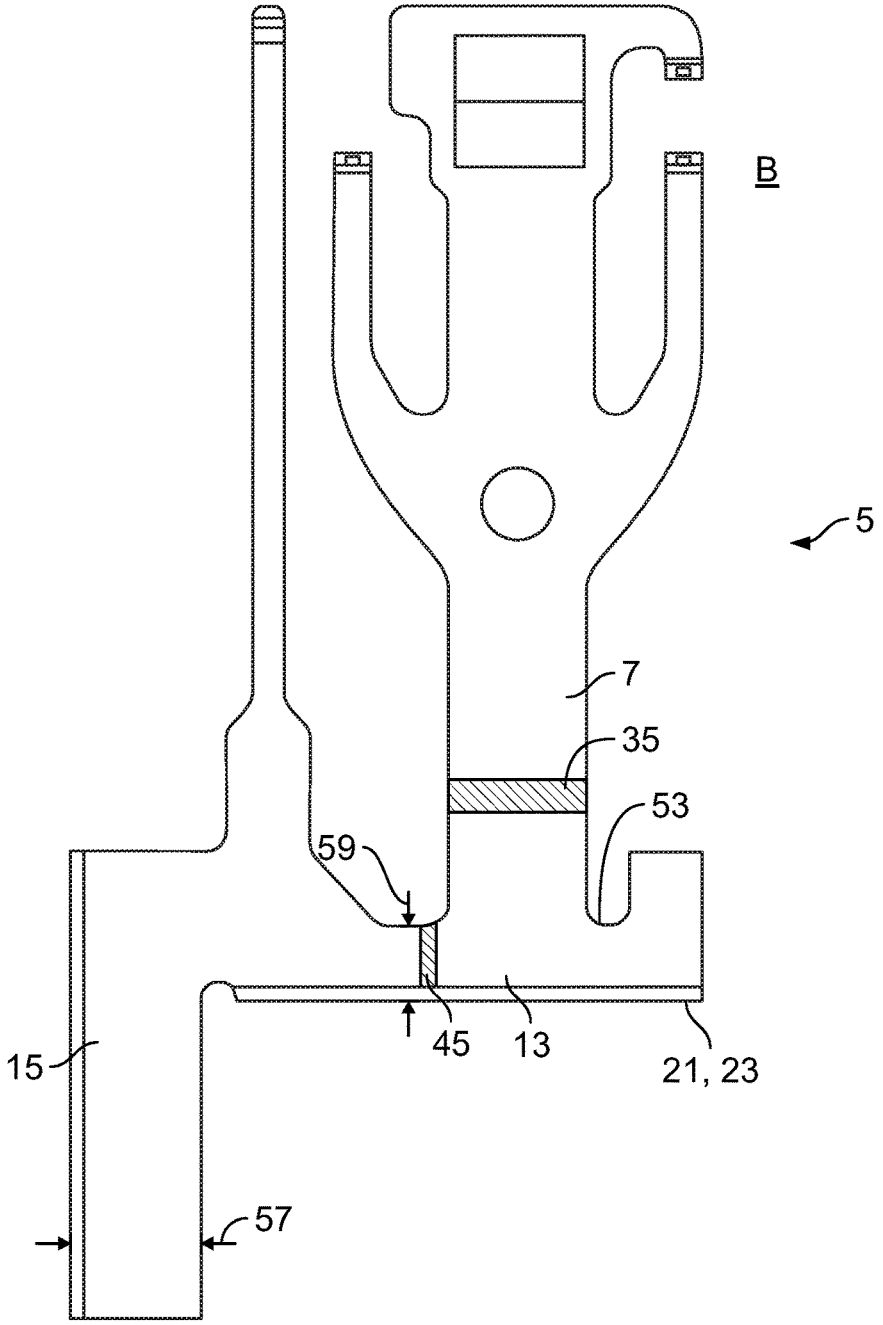
FIG. 2 is a top view of the spring of FIG. 1 in a bent state.
Figure 3:
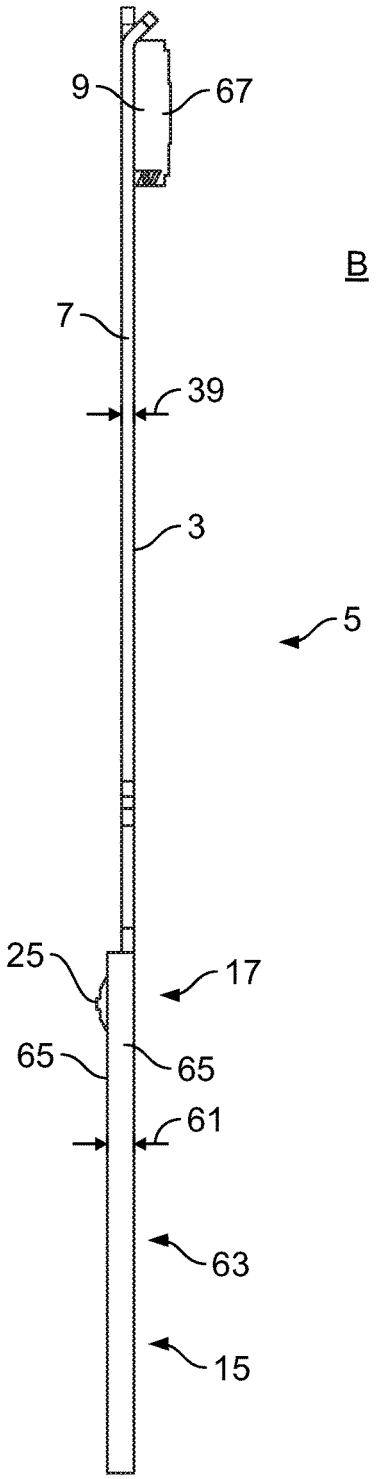
FIG. 3 is a side view of the spring of FIG. 1 in the bent state.

A spring 5 according to the invention is shown in FIGS. 1-3. A monolithic sheet material 3 is stamped and bent into a stamped-bent part 1 to form the spring 5. The spring 5, as shown in FIG. 1, comprises a contact arm 7 and a base 13 from which the contact arm 7 extends. The spring 5 is shown in a pre-bent state P in FIG. 1.

The contact arm 7, as shown in FIG. 1, extends essentially along a longitudinal axis L and has a contact member 9. In other embodiments, the contact arm 7 may have more than one contact member 9. The contact member 9 is disposed on an elastically deflectable free end 11 of the contact arm 7. The entire contact arm 7 is elastically deflectable in a direction perpendicular to both the longitudinal direction L and a plane defined by the sheet material 3. The contact arm 7 extends from the base 13 and is elastically deflectable with respect to the base 13.

The base 13 forms a stationary part of the spring 5 in an electrical switch (not shown). The base 13, as shown in FIG. 1, has a terminal 15 and an extension 17. The terminal 15 electrically connects the spring 5 to other elements. In various embodiments, the terminal 15 may form a contact pin for a mating connection element or may be soldered to electrical conductors. The extension 17, as shown in FIG. 1, extends from the contact arm 7 to the terminal 15 and away from a remaining base 13 not consisting of the terminal 15 and the extension 17. In the pre-bent state P shown in FIG. 1, the extension 17 is still in the same plane as the rest of the sheet material 3.

As shown in FIG. 1, the spring 5 provides a current path 19. The current path 19 extends from the contact member 9 to the terminal 15 through the base 13 including the extension 17; the extension 17 contributes to the electrical conductivity and to the current transport of the spring 5.

The spring 5 has a folding edge 21 as shown in FIG. 1. The sheet material 3 is folded along the folding edge 21 in order to form the extension 17 which protrudes away from the remaining base 13; the extension 17 is shown in a pre-bent state P in FIG. 1. In the shown embodiment, the extension 17 is formed by folding the sheet material 3 around the folding edge 21 to an angle greater than 0° and less than or equal to 180°. When the extension 17 is folded around more than 90° around the folding edge 21, as shown in the bent state B in FIG. 2, the folding edge 21 defines a lower border of the base 13. In the shown embodiment, the folding edge 21 extends perpendicular to the longitudinal direction L of the contact arm 7 and the extension 17 extends along the whole length of the folding edge 21.

The extension 17, as shown in FIG. 1, has a fixation element 25 formed by stamping or punching the sheet material 3. In the shown embodiment, the extension 17 has two fixation elements 25. The fixation elements 25, as shown in FIG. 3, protrude from a plane of the sheet material 3 and are used to fix the spring 5 in a body or housing of an electrical switch. In the bent state B shown in FIG. 3, the fixation elements 25 protrude from the sheet material 3 in a direction opposing a direction in which a contact element 67 is arranged on the contact member 9. The fixation elements 25 are disposed on support bases 27 which protrude from the extension 17. The support bases 27 are shaped identically to parts of the spring 5 mirrored about the folding edge 21, therefore, when the extension 17 is folded 180° around the folding edge 21, the support bases 27 abut the identically-shaped counterparts so that the fixation elements 25 are supported by a double-layered structure.

The contact arm 7, as shown in FIG. 1, has a width 29 constant over most of the contact arm 7 except for a spring arm extension 31, in which two identically-shaped spring arms 33 protrude from the contact arm 7. In order to keep a cross-sectional area 35 of the contact arm 7 constant along the longitudinal direction L, the contact arm 7 has an opening 37 in the spring arm extension 31, which maintains a constant flexibility of the contact arm 7 along the longitudinal direction L. In the case of a single layer of sheet material 3, the cross-sectional area 35 is defined by the width 29 multiplied by a thickness 39 of the sheet material 3 shown in FIG. 3.

The width 29 of the contact arm 7 measured perpendicular to the longitudinal direction L is the smallest width 29 of the contact arm 7. The width 29 is identical to a smallest width 41 of the base 13 including the extension 17, which is identical to the width 43 of the terminal 15. The widths 41 and 43 refer to the spring 5 prior to any bending steps. With the widths 29, 41, 43 as described, the current path 19 extends along the spring 5 without extending through a section where the width is lower than the width 29 of the contact arm 7; a constant cross-sectional area is achieved along the current path 19. When the sheet material 3 of the extension 17 is folded around the folding edge 21, a cross sectional area 45 of the base 13 including the extension 17, defined by the width 41 of the base 13 multiplied by the thickness 39, remains constant even though the width 41 is decreased after folding. A smallest cross-sectional area 45 of the base 13 including the extension 17 is equal to a smallest cross-sectional area 35 of the contact arm 7.

The contact arm 7, as shown in FIG. 1, has a total length 47 measured from a center 49 of the contact member 9 to a lower border 23 of the base 13. Since the base 13 may form a stationary part in an electrical switch, an effective length 51 of the contact arm 7 is measured between the center 49 of the contact member 9 and a connection portion 53 of the contact arm 7. The connection portion 53 is the position at which the contact arm 7 extends from the base 13. The remaining base 13 has a small area between the folding edge 21 and the connection portion 53 and the effective length 51 is comparatively large.

The terminal 15, as shown in FIG. 1, has a terminal folding edge 55. The terminal folding edge 55 extends essentially parallel to the longitudinal direction L. In the bent state B of the spring 5 as shown in FIGS. 2 and 3, a width 57 of the terminal 15 folded along the terminal folding edge 55 is about half the width 43 of the terminal 15 in the pre-bent state P. The terminal 15, however, has an identical cross-sectional area in the pre-bent state P and bent state B. In other embodiments, the terminal 15 may be folded differently or may not be folded at all.

The same applies for the base 13 as shown in FIGS. 2 and 3, which has a width 59 in the bent state B which is about half the width 41 in the pre-bent state P, wherein the cross-sectional area 45 remains the same. The width 59 of the base 13 in the bent state B is measured between the connection portion 53 and the lower border 23.

As shown in FIG. 3, in the bent areas formed by the folded terminal 15 and the folded extension 17, the total thickness 61 is two times the thickness 31 of the sheet material when the extension 17 is folded around the folding edge 21 by 180° to form a double layer structure 63. The double layer structure 63 consists of two layers 65 of sheet material 3.

What is claimed is:

1. A spring for an electrical switch, comprising:

a contact arm having a contact member; and a base from which the contact arm extends, the base having a terminal and an extension extending from a remaining portion of the base not consisting of the terminal and the extension in a direction away from the contact arm, the spring provides a current path extending from the contact member through the remaining portion of the base including the extension and to the terminal, the contact arm and the base having a constant cross-sectional area along the current path in both a pre-bent state and a bent state of the base, a smallest cross-sectional area of the contact arm in a direction perpendicular to a longitudinal direction of the contact arm is equal to a smallest cross-sectional area of the remaining portion of the base including the extension in a direction parallel to the longitudinal direction of the contact arm.

2. The spring of claim 1, wherein a smallest width of the base including the extension is equal to a smallest width of the contact arm in the pre-bent state of the base.

3. The spring of claim 2, wherein, in the bent state, the base is formed by at least two layers of a sheet material including the remaining portion of the base and the extension.

4. The spring of claim 3, wherein the extension is formed by folding the sheet material along a folding edge.

5. The spring of claim 4, wherein the extension is folded 180° about the folding edge.

6. The spring of claim 4, wherein the folding edge extends perpendicular to the longitudinal direction of the contact arm.

7. The spring of claim 4, wherein the base has a width in the bent state after folding the extension which is approximately half a width of the base in the pre-bent state prior to folding the extension.

8. The spring of claim 1, wherein the spring is formed from a stamped and bent sheet material.

9. The spring of claim 1, wherein the extension has a fixation element fixing the base to an electrical switch.

10. The spring of claim 9, wherein the base is a stationary part of the spring in the electrical switch and the contact arm is elastically deflectable with respect to the base.

11. The spring of claim 3, wherein the terminal is formed by folding the sheet material along a folding edge.

12. The spring of claim 11, wherein the folding edge extends parallel to the longitudinal direction of the contact arm.

13. The spring of claim 11, wherein the terminal has a width in the bent state after folding which is approximately half a width of the terminal in the pre-bent state prior to folding.

14. The spring of claim 2, wherein a pair of spring arms extend from the contact arm.

15. The spring of claim 14, wherein the contact arm has an opening disposed between the pair of spring arms.

16. An electrical switch, comprising:

a spring including a contact arm having a contact member and a base from which the contact arm extends, the base having a terminal and an extension extending from a remaining portion of the base not consisting of the terminal and the extension in a direction away from the contact arm, the spring provides a current path extending from the contact member through the remaining portion of the base including the extension and to the terminal, the contact arm and the base having a constant cross-sectional area along the current path in both a pre-bent state and a bent state of the base, a smallest cross-sectional area of the contact arm in a direction perpendicular to a longitudinal direction of the contact arm is equal to a smallest cross-sectional area of the remaining portion of the base including the extension in a direction parallel to the longitudinal direction of the contact arm.

17. The spring of claim 1, wherein the extension is disposed in a same plane as the remaining portion of the base, the terminal, and the contact arm in the pre-bent state of the base.

18. The spring of claim 17, wherein, in the bent state of the base, the extension is disposed in a different plane than the remaining portion of the base and the contact arm and the remaining portion of the base and the contact arm are disposed in the same plane.

19. The spring of claim 17, wherein the extension has a same thickness as the remaining portion of the base, the terminal, and the contact arm in the pre-bent state of the base.

* * * * *